US006864426B2

(12) United States Patent
Miyazaki

(10) Patent No.: US 6,864,426 B2
(45) Date of Patent: Mar. 8, 2005

(54) SHIELDED WIRE HARNESS AND SHIELDING MEMBER

(75) Inventor: Sho Miyazaki, Aichi (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/718,597

(22) Filed: Nov. 24, 2003

(65) Prior Publication Data

US 2004/0099428 A1 May 27, 2004

(30) Foreign Application Priority Data

Nov. 26, 2002 (JP) ..... 2002-342545

(51) Int. Cl.[7] ..... H02G 15/08
(52) U.S. Cl. ..... 174/75 C; 174/78
(58) Field of Search ..... 174/74 R, 756, 174/78, 84 C; 439/271, 610

(56) References Cited

U.S. PATENT DOCUMENTS 2,798,113 A * 7/1957 Koller et al. ..... 174/75 C
3,744,128 A * 7/1973 Fisher et al. ..... 29/858
6,583,352 B2 * 6/2003 Fukushima et al. ..... 174/35 R
2003/0221850 A1 * 12/2003 Mizutani ..... 174/36

FOREIGN PATENT DOCUMENTS

JP A 11-26093 1/1999

* cited by examiner

*Primary Examiner*—Chau N. Nguyen
(74) *Attorney, Agent, or Firm*—Oliff & Berridge, PLC

(57) ABSTRACT

A shielding member is configured by connecting an intermediate shielding member which can collectively enclose regions of a plurality of wires excluding terminal portions in a state where the regions are bundled, to a terminal shielding member which is larger in diameter than the intermediate shielding member, and which can collectively enclose the terminal portions of the wires in a state where the terminal portions are spread apart. The portions of the wires excluding the terminal portions are enclosed by the intermediate shielding member which is relatively thin, and hence the space required for laying the wires can be reduced. Since the terminal portions of the wires are enclosed by the terminal shielding member of a larger diameter, the shielding member can cope with the case where the terminal portions of the wires are laid while being laterally spread.

4 Claims, 6 Drawing Sheets

SHIELDED WIRE HARNESS AND SHIELDING MEMBER

BACKGROUND OF THE INVENTION

1. Field of the Invention

The present invention relates to a shielded wire harness, and also to a shielding member for such a wire harness.

2. Description of the Related Art

In the case where equipments in an electric vehicle such as an inverter equipment and a motor are to be connected to each other, for example, a shielded wire harness is used. As an example of a wire harness of this kind, known is a wire harness in which wire terminals are connected to end portions of conductors of shielded wires, the wire terminals are connected to equipment terminals disposed in a shield case of equipment, and shield layers of the shielded wires are connected to the shield case via a conductive connection members (see JP-A-11-026093).

In such a wire harness, inserting a wire terminal into a shield case, and connecting a connection member to the shield case must be repeated the same number of times as that of terminals (i.e., the number of the shielded wires), thereby producing a problem in that the wire harness requires cumbersome works in assembling.

In order to solve the problem, a structure may be employed in which wires having no shield layer are used, the wires are collectively covered by a flexible tubular shielding member formed by braiding, and wire terminals are connected to the wires, respectively. In such a wire harness of the common shield type, a work of connecting a shielding function portion (the shielding member) to a shield case is requested to be conducted only one time irrespective of the number of the wires, and hence the workability is improved.

In the case where a plurality of wires are juxtaposedly laid and wire terminals connected to terminal portions of the wires are attached to equipment, terminals of the equipment are laterally arranged so as to be separated from one another because of reasons such as avoidance of a short circuit. Even when the portions of the wires excluding the terminal portions are laid in a bundled state, therefore, the terminal portions of the wires are laid so as to be spread into a fan-like shape in accordance with the arrangement of the equipment terminals. In order to enclose the laterally spread terminal portions of the wires, a shielding member which has a long peripheral length or a large diameter is used.

In the case where wires are to be laid in a place where a sufficient space is not formed, such as an automobile, the wires are requested to be bundled so as to be thinned as far as possible on the whole, in order to reduce the space for the laying path. Therefore, it is not preferable to use a shielding member of such a large diameter.

As a method of reducing the space for the laying path, the following technique may be employed. A member which is formed by metal thin lines braided in a meshed manner is used as a shielding member. The shielding member has a small diameter corresponding to the diameter of a bundle of wires, and only a terminal portion of the shielding member is laterally widened. When such a shielding member is widened, large gaps are formed among thin metal wires, thereby causing the possibility that the shielding function is impaired.

SUMMARY OF THE INVENTION

It is therefore an object of the invention to reduce a space of a laying path while coping with the case where terminal portions of wires are laid while being spread.

In order to achieve the object, according to a first aspect of the invention, there is provided a shielded wire harness including: a plurality of wires arranged to be juxtaposed to one another; a plurality of wire terminals each connected to a terminal portion of the respective wires, and each configured to be connected to a respective terminal disposed in a shield case of equipment; and a shielding member having a tubular shape and flexible characteristic and configured to enclose the plurality of wires collectively, and an end portion thereof is configured to be connected to the shield case, wherein the shielding member includes: an intermediate shielding member configured to enclose the plurality of wires collectively except for the terminal portion; a terminal shielding member connected to the intermediate shielding member and having larger diameter than that of the intermediate shielding member, and configured to enclose the plurality of wires collectively at the terminal portion where the plurality of wires are spread apart.

According to a second aspect of the invention, there is provided a shielding member for collectively enclosing a plurality of wires arranged to be juxtaposed to one another and each configured to be connected to a respective terminal disposed in a shield case of equipment, the shielding member including: an intermediate shielding member configured to enclose the plurality of wires collectively except for a terminal portion of the plurality of wires; a terminal shielding member connected to the intermediate shielding member and having larger diameter than that of the intermediate shielding member, and configured to enclose the plurality of wires collectively at the terminal portion where the plurality of wires are spread apart, wherein an end portion of the shielding member is configured to be connected to the shield case.

BRIEF DESCRIPTION OF THE DRAWINGS

The objects and advantages of the present invention will become more apparent by describing preferred embodiments thereof in detail with reference to the accompanying drawings, wherein.

DETAILED DESCRIPTION OF THE PREFERRED EMBODIMENTS

Figure 1:
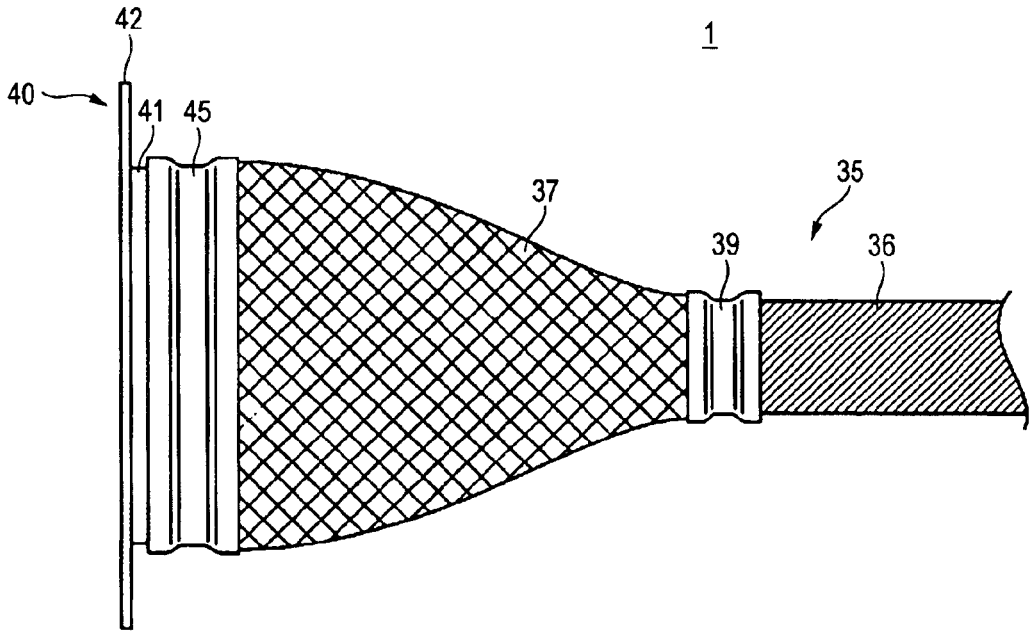
FIG. 1 is a plan view showing a state where, in a first embodiment, an intermediate shielding member and a large-diameter shielding member are connected to each other.
Figure 2:
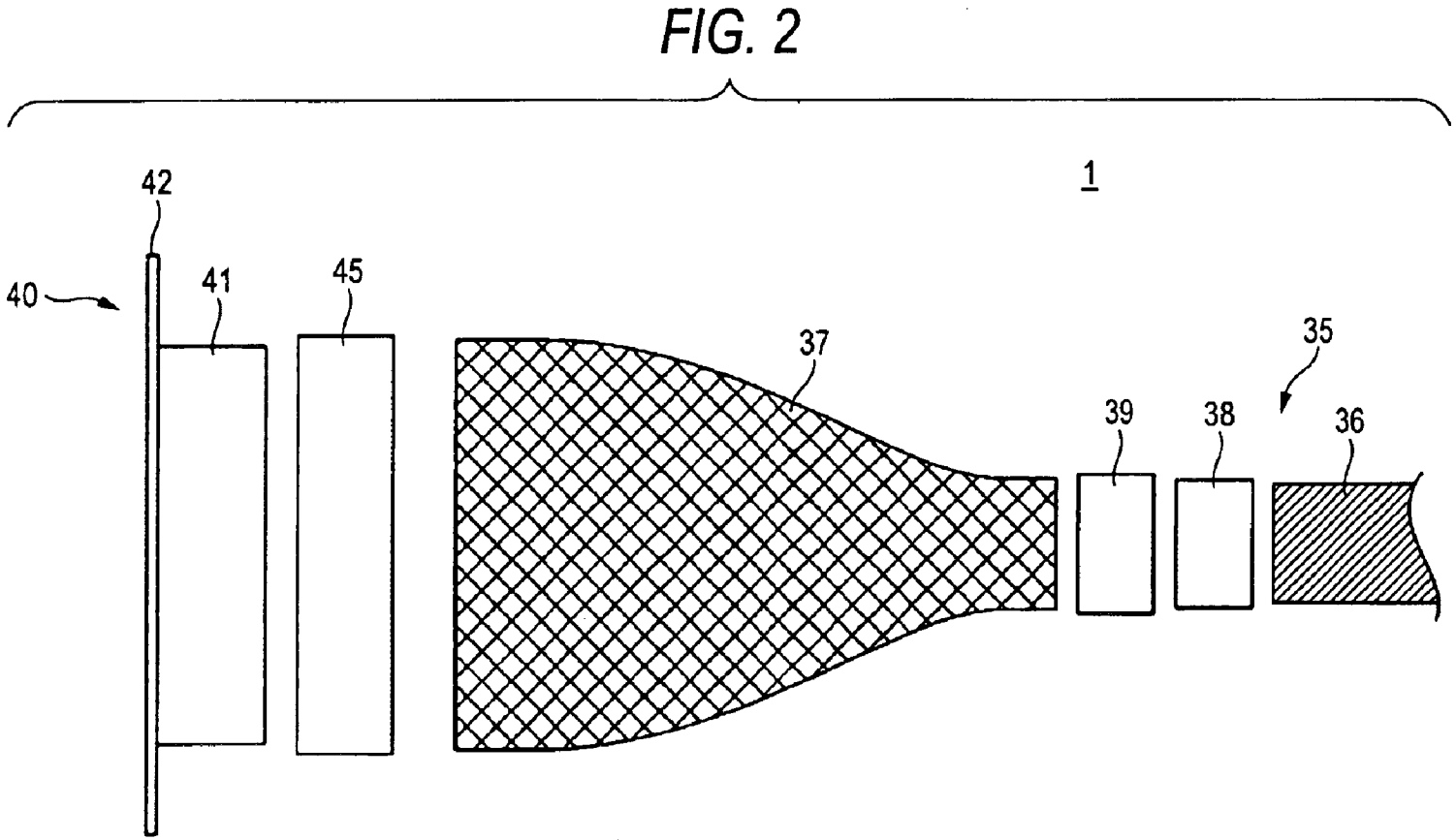
FIG. 2 is a plan view showing a state before the intermediate shielding member and a terminal shielding member are connected to each other.
Figure 3:
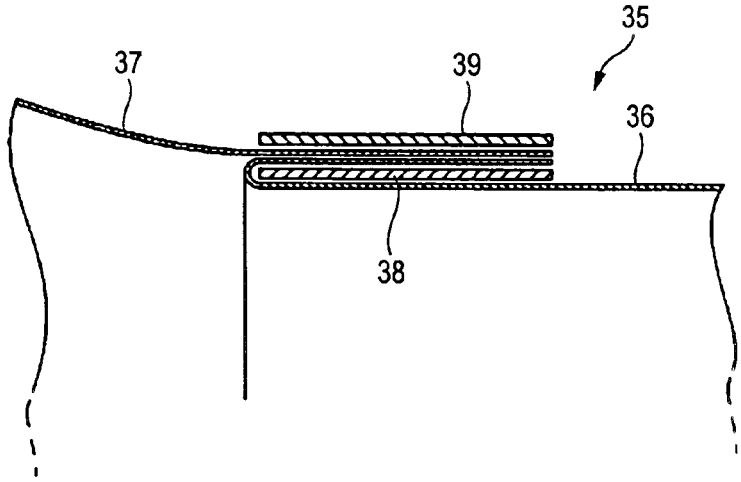
FIG. 3 is a partial enlarged section view showing a step of connecting the intermediate shielding member to the terminal shielding member.

Referring now to the accompanying drawings, a description will be given in detail of a preferred embodiment of the invention.

First Embodiment

Hereinafter, a first embodiment according to the invention is embodied will be described with reference to FIGS. 1 through 7.

A wire harness 1 according to the first embodiment having a shielding function is used for connecting equipments in an electric vehicle such as an inverter equipment and a motor with each other.

Equipment 10 is configured so that equipment body 12 and three equipment terminals 13 led out from the equipment body 12 are accommodated in an electrically conductive shield case 11. Each of the equipment terminals 13 is a plate-like terminal which is a so-called bus bar, and has a bolt hole 14 which is vertically opened in the terminal. The three equipment terminals 13 are arranged so as to be horizontally juxtaposed with forming predetermined gaps in the lateral directions. Three circular mounting holes 15 are formed in the side wall of the shield case 11 to be laterally arranged so as to respectively correspond to the equipment terminals 13.

Next, the wire harness 1 will be described. The wire harness 1 includes a plurality of wires 20, wire terminals 25, enclosures 30, a shielding member 35, and a shield shell 40.

In each of the wires 20, an insulation cover 21 encloses a conductor (not shown), and, unlike a shielded wire, a shield layer is not disposed. The wire terminals 25 are connected to terminal portions of the wires 20, respectively.

Equipment connecting portion 26 which is formed into a longitudinally elongated flat plate-shape, and which has a bolt hole 27 that is vertically opened is formed in a front end portion of each of the wire terminals 25. The conductor of the wire 20 is conductively connected by clamping to a wire clamp portion (not shown) in a rear end portion of the wire terminal 25.

Each of the enclosures 30 is molded integrally with the corresponding wire terminal 25 by resin molding so as to enclose the wire clamp portion of the wire terminal 25 and the terminal portion of the wire 20. The equipment connecting portion 26 protrudes from the front face of the enclosure 30, and a portion of the wire 20 which is covered by the insulation cover 21 is led out from the rear end face. The outer periphery of the rear end portion of the enclosure 30 is a circular portion which is concentric with the wire 20. A sealing ring 32 is attached to a seal groove 31 formed in the outer peripheral face of the rear end portion.

The shielding member (bracket shield) 35 is structured by connecting a tubular terminal shielding member 37 configured by a braided wires which is formed by metal thin lines braided in a meshed manner, to a terminal portion of a tubular intermediate shielding member 36 configured by a braided wires which is similarly formed by metal thin lines braided in a meshed manner. The shielding member 35 collectively encloses the three wires 20. The terminal portions of the three wires 20 which are passed through the shielding member 35 are led out from both the ends of the shielding member 35. The intermediate shielding member 36 and the terminal shielding member 37 are slightly expandable and contractable in the radial and axial directions because of the flexibility of the thin metal wires.

The circumferential length of the intermediate shielding member 36 (in the case where the intermediate shielding member 36 is formed into a cylindrical shape, the diameter) is constant over the whole length. In the case where the intermediate shielding member 36 is formed into a cylindrical shape, the diameter is set to a dimension at which, when the three wires 20 are bundled in a pyramidal shape (triangular shape) so as to be substantially in close contact with each other, the intermediate shielding member 36 generally circumscribes the bundle of the three wires 20. Namely, the three wires 20 can be passed through the interior of the intermediate shielding member 36.

The circumferential length of the terminal shielding member 37 (in the case where the terminal shielding member 37 is formed into a cylindrical shape, the diameter) is not constant over the whole length. Namely, the circumferential length is set so as to be increased at a constant rate as advancing from the rear end (the end portion to be connected to the intermediate shielding member 36) to the front end (the end portion to be connected to the shield shell 40). When the terminal shielding member 37 is pressed to a flattened state, therefore, the member exhibits a generally trapezoidal shape as a whole. The circumferential length of the rear end portion of the terminal shielding member 37 is substantially equal to that of the intermediate shielding member 36. Consequently, the terminal shielding member 37 is larger as a whole in circumferential length than the intermediate shielding member 36 (larger in diameter). When the terminal shielding member 37 encloses the terminal portions of the wires 20, the member is shaped so that the rear end portion has a cylindrical shape, and the member has a generally oval shape (or a generally elliptic shape) which is more laterally elongated as further advancing from the rear end toward the front end. The front end portion of the terminal shielding member 37 is ensured to have a circumferential length which is sufficiently large so as to allow the front end portion to collectively enclose the three wire terminals 25 that are laterally arranged with forming gaps so as to correspond to the arrangement of the equipment terminals 13.

The intermediate shielding member 36 and the terminal shielding member 37 are connected to each other by an underlay pipe 38 and a clamp ring 39. The underlay pipe 38 is made of a metal material having a high rigidity, and has a circular shape which is approximately equal in diameter to the intermediate shielding member 36. The clamp ring 39 has a cylindrical shape in which the diameter is slightly larger than that of the underlay pipe 38.

The underlay pipe 38 is fitted from the front side onto the front end portion of the intermediate shielding member 36. A portion of the intermediate shielding member 36 which is projected forward from the underlay pipe 38 is folded back so as to extend along the outer peripheral face of the underlay pipe 38. The rear end portion of the terminal shielding member 37 is fitted from the front side onto the folded portion of the intermediate shielding member 36. The clamp ring 39 which is previously fitted onto the intermediate shielding member 36 is fitted from the rear side onto the rear end portion of the terminal shielding member 37 (see FIG. 3).

Figure 4:
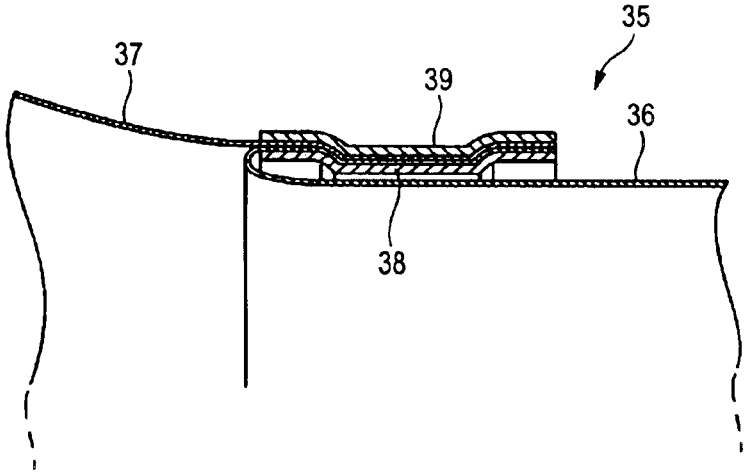
FIG. 4 is a partial enlarged section view showing a state where the intermediate shielding member and the terminal shielding member are connected to each other.
Figure 5:
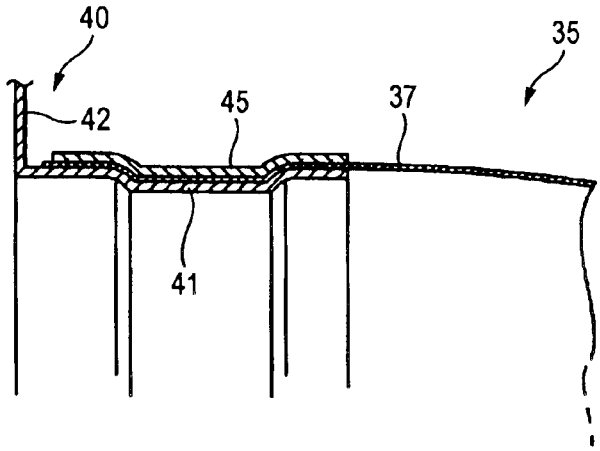
FIG. 5 is a partial enlarged section view showing a state where the terminal shielding member and a shield shell are connected to each other.
Figure 6:
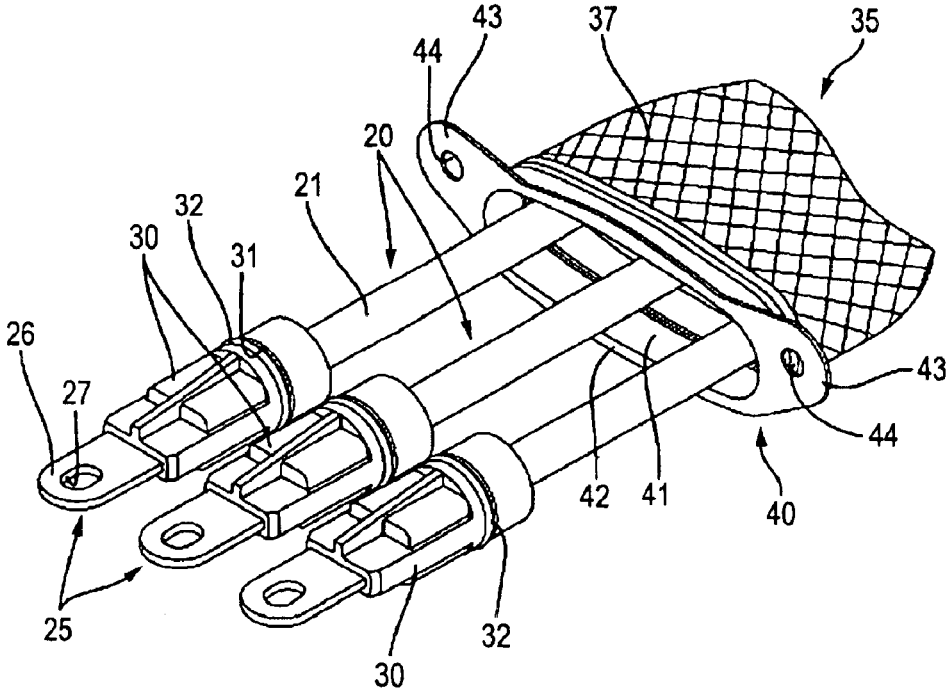
FIG. 6 is a perspective view of the terminal shielding member and wire terminals.
Figure 7:
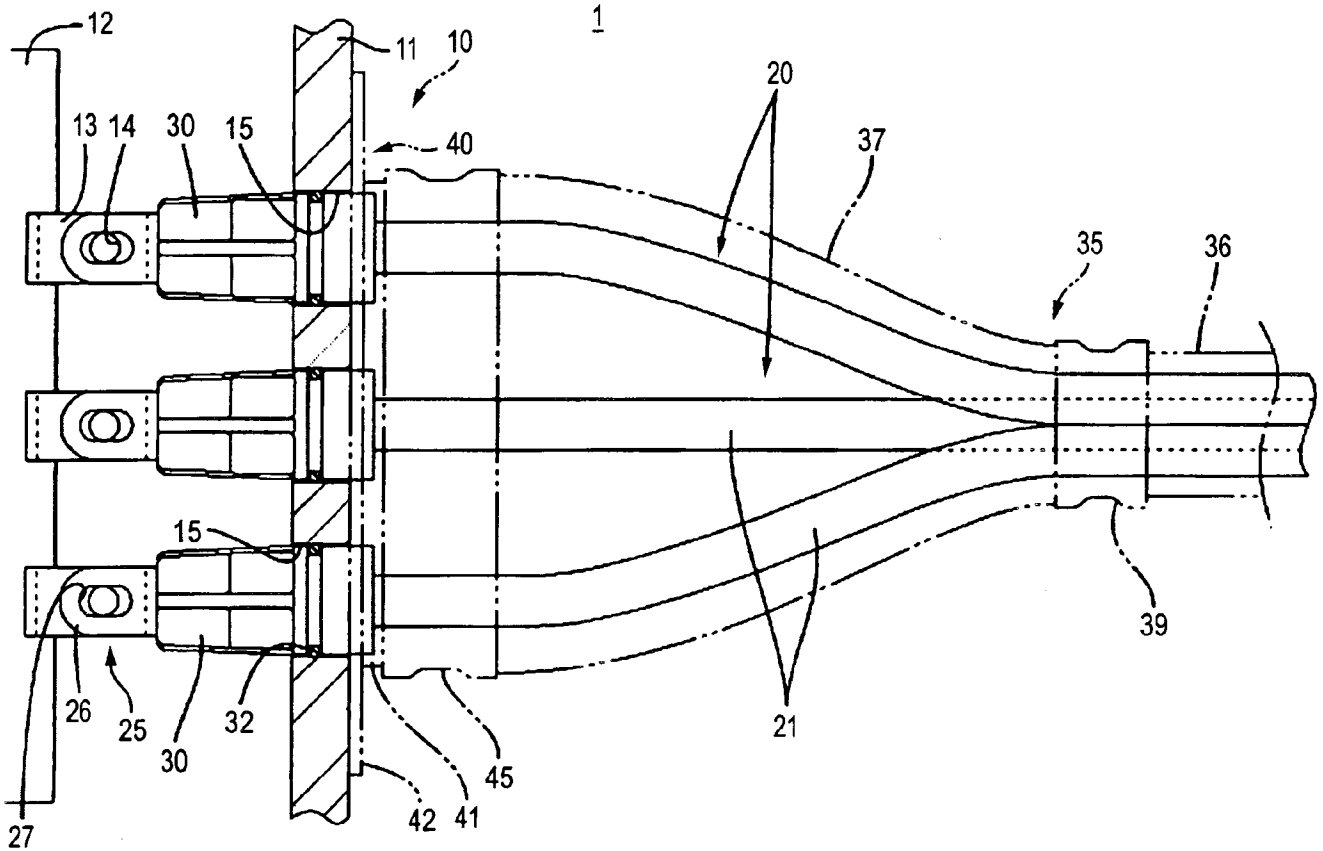
FIG. 7 is a plan view showing a state where a wire harness is attached to equipment.

Under this state, the clamp ring 39 is clamped inward by a clamping die (not shown), so that the folded portion of the intermediate shielding member 36, and the rear end portion of the terminal shielding member 37 are fixed in the state where they are clamped between the underlay pipe 38 and the clamp ring 39 (see FIG. 4). As a result, the front end portion of the intermediate shielding member 36, and the rear end portion of the terminal shielding member 37 are conductively connected to each other while being formed into a cylindrical shape.

The shield shell 40 is configured by a single component which is shaped by applying a deep drawing process on a metal blank, and has: a cylindrical portion 41 having an generally oval shape (or a generally elliptic shape) which is laterally elongated as a whole; a plate-like flange portion 42 which outward extends from the whole periphery of the front edge of the cylindrical portion 41; and a pair of mounting portions 43 which extend in obliquely outward and upward directions from lateral ends of the flange portion 42 in a flush manner, respectively. The front faces of the flange portion 42 and the mounting portions 43 butt against the outer wall face of the shield case 11 so as to form a surface contact. In each of the mounting portions 43, a bolt hole 44 corresponding to a tapped hole (not shown) of the shield case 11 is formed.

The shield shell 40 is connected to the front end portion of the terminal shielding member 37 in the following manner. The front end portion of the terminal shielding member 37 is put from the rear side onto the cylindrical portion 41 of the shield shell 40. A generally oval clamp ring 45 which is slightly larger than the cylindrical portion 41 is fitted onto the outer periphery of the front end portion, and the clamp ring 45 is then clamped. This clamping causes the front end portion of the terminal shielding member 37 to be fixed in the state where it is clamped between the cylindrical portion 41 and the clamp ring 45 (see FIG. 5). As a result, the front end portion of the terminal shielding member 37, and the shield shell 40 are conductively connected to each other, or, in other words, the shielding member 35 and the shield shell 40 are connected to each other. The three wire terminals 25, and the terminal portions of the three wires 20 are forward led out from the shield shell 40.

The thus configured wire harness 1 is connected to the equipment 10 in the following manner. The wire terminals 25 are inserted into the mounting holes 15 of the shield case 11, respectively. The equipment connecting portion 26 of each of the wire terminals 25 is placed on the upper face of the corresponding equipment terminal 13 placed in the shield case 11 so that the bolt holes 14, 27 correspond to each other. A nut (not shown) is screwingly fastened with a bolt (not shown) which is passed through the bolt holes 14, 27, whereby the terminals 13, 25 are fixed in a state where a swing operation is restricted, and conductively connected to each other. In each of the mounting holes 15, the space between the inner periphery of the hole and the outer periphery of the enclosure 30 is sealed by the sealing ring 32.

After the connections between the terminals 13 and 25 are ended, the shield shell 40 is attached to the shield case 11 in the following manner. The bolt holes 44 of the shield shell 40 are placed so as to correspond to the tapped holes of the shield case 11, and bolts (not shown) inserted into the bolt holes 44 are then fastened into the tapped holes, respectively, whereby the shield shell 40 is fixed and conductively connected to the shield case 11. As a result, the shielding member 35 is connected via the shield shell 40 to the shield case 11, thereby completing the attachment of the wire harness 1 to the equipment 10.

In this state, the terminal portions of the three wires 20 are laid in the terminal shielding member 37 so as to be spread with being forward directed. The terminal shielding member 37 has a tapered shape in which the width is made larger as further forward advancing. In the terminal shielding member 37, therefore, the three wires 20 are accommodated with forming a sufficient marginal space and without being compulsively bent.

As described above, in the wire harness 1 of the embodiment, the shielding member 35 is configured by connecting the intermediate shielding member 36 which can collectively enclose the regions of the wires 20 excluding the terminal portions in the state where the regions are bundled, to the terminal shielding member 37 which is larger in diameter than the intermediate shielding member 36, and which can collectively enclose the terminal portions of the wires 20 in the state where the terminal portions are spread apart. According to the configuration, the portions of the wires 20 excluding the terminal portions are enclosed by the intermediate shielding member 36 which is relatively thin, and hence the space required for laying the wires 20 can be reduced. Since the terminal portions of the wires 20 are enclosed by the terminal shielding member 37 of a larger diameter, the shielding member can cope with the case where the terminal portions of the wires 20 are laid while being laterally spread.

In the case where the space for laying the wires 20 is limited, the terminal portions of the wires 20 may be bent at a small radius of curvature. By contrast, in the embodiment, the terminal shielding member 37 is configured by a braided wires which is formed by metal thin lines braided in a meshed manner. Therefore, the terminal shielding member can be flexibly deformed while following the laying path of the terminal portions of the wires 20.

In the terminal shielding member 37 which is formed by a braided wire, there is the possibility that, when the member is forcibly spread, large gaps are formed among thin metal wires to impair the shielding function. By contrast, in the embodiment, the terminal shielding member 37 originally has a larger diameter. Even when the terminal portions of the wires 20 are laid while being spread, therefore, it is not necessary to widen the terminal shielding member 37. Consequently, the shielding function can be ensured.

Second Embodiment

Figure 8:
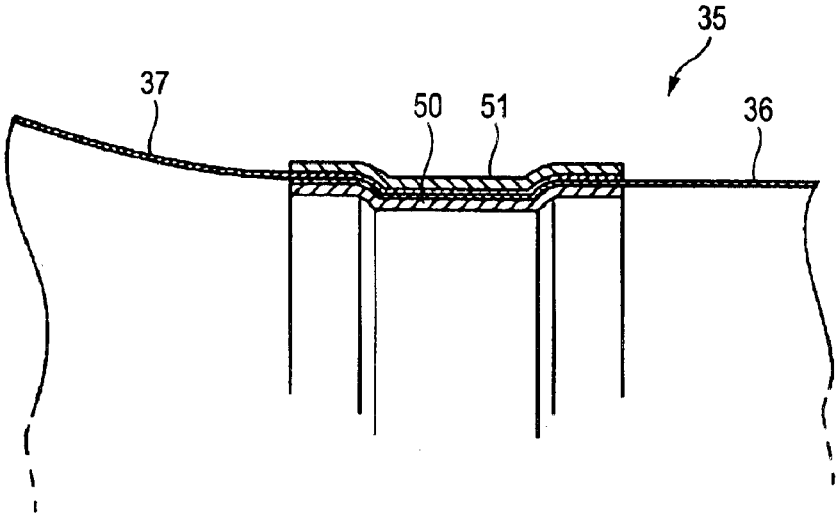
FIG. 8 is a partial enlarged section view showing a state where, in a second embodiment, an intermediate shielding member and a terminal shielding member are connected to each other.

Next, a second embodiment in which the invention is embodied will be described with reference to FIG. 8.

In the second embodiment, the structure of connecting the intermediate shielding member 36 and the terminal shielding member 37 is configured in a manner different from that of Embodiment 1. The front end portion of the intermediate shielding member 36 is fitted onto the outer periphery of an underlay pipe 50. The rear end portion of the terminal shielding member 37 is fitted onto the front end portion of the intermediate shielding member 36. A clamp ring 51 is fitted onto the rear end portion of the terminal shielding member 37. The clamp ring 51 is clamped, so that the intermediate shielding member 36 and the terminal shielding member 37 are clamped to be fixed, whereby they are conductively connected to each other. The other configuration is identical with that of the first embodiment. Therefore, the identical components are denoted by the same reference numerals, and the description of their structures, functions, and effects will be omitted.

The invention is not limited to the embodiments which are described above and illustrated in the drawings. For example, the following embodiments also falls within the technical scope of the invention, and other various modifications can be made without departing form the spirit of the invention.

(1) In the embodiments, the terminal shielding member has a tapered shape in which the diameter is made larger as further advancing toward an end portion. In the invention, alternatively, the terminal shielding member may have a constant diameter. In this case, a connecting member having two stepwise cylindrical portions of different diameters may be used as means for connecting the intermediate shielding member to the terminal shielding member.

(2) In the embodiments, the shield shell is formed by a metal sheet. In the invention, an aluminum die-cast shield shell may be used.

(3) In the embodiments, the intermediate shielding member is configured by a braided wires which can be easily deformed. In the invention, the intermediate shielding member is not restricted to a braided wire, and may be configured by a tubular sheet member made of a metal, a tubular member (pipe) made of a metal having a high rigidity, that made of conductive rubber, or that made of a conductive resin.

(4) In the embodiments, the terminal shielding member is configured by a braided wires which can be easily deformed. In the invention, the terminal shielding member is not restricted to a braided wire, and may be configured by a tubular sheet member made of a metal, a tubular member (pipe) made of a metal having a high rigidity, that made of conductive rubber, or that made of a conductive resin.

(5) In the embodiments, the intermediate shielding member and the terminal shielding member are connected to each other by clamping. In the invention, the members may be connected to each other by welding.

(6) In the above, the embodiments in which the wire terminals are separately attached to the equipment have been described. The invention maybe applied also to a case where a plurality of wire terminals are collectively held by one housing, and the wire terminals are attached to equipment in a single action.

(7) In the embodiments, a corrugated tube may be externally attached to the intermediate shielding member, and a cover having a substantially similar shape may be externally attached to the terminal shielding member. When such a corrugated tube or a cover is put on the intermediate shielding member or the terminal shielding member, it is possible to protect the member.

According to the invention, since the portions of the wires excluding the terminal portions are enclosed by the intermediate shielding member which is relatively thin, the space required for laying the wires can be reduced. The terminal portions of the wires are enclosed by the terminal shielding member of a larger diameter. Therefore, the shielding member can cope with the case where the terminal portions of the wires are laid while being laterally spread.

According to the invention, in the case where the space for laying wires is limited, terminal portions of the wires may be bent at a small radius of curvature. By contrast, in the invention, the terminal shielding member is configured by a braided wires which is formed by metal thin lines braided in a meshed manner. Therefore, the terminal shielding member can be flexibly deformed while following the laying path of the terminal portions of the wires.

According to the invention, in a terminal shielding member which is formed by a braided wire, there is the possibility that, when the member is forcibly spread, large gaps are formed among thin metal wires to impair the shielding function. By contrast, in the invention, the terminal shielding member originally has a larger diameter. Even when the terminal portions of the wires are laid while being spread, therefore, it is not necessary to widen the terminal shielding member. Consequently, the shielding function can be ensured.

Although the present invention has been shown and described with reference to specific embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A shielded wire harness comprising:

a plurality of wires arranged to be juxtaposed to one another;

a plurality of wire terminals each connected to a terminal portion of the respective wires, and each configured to be connected to a respective terminal disposed in a shield case of equipment; and a shielding member having a tubular shape and flexible characteristic and configured to enclose the plurality of wires collectively, and an end portion thereof is configured to be connected to the shield case, wherein the shielding member comprises:

an intermediate shielding member configured to enclose the plurality of wires collectively except for the terminal portion; and a terminal shielding member connected to the intermediate shielding member and having larger diameter than that of the intermediate shielding member, and configured to enclose the plurality of wires collectively at the terminal portion where the plurality of wires are spread apart, the terminal shielding member and the intermediate shielding member being conductively connected to each other by having a front end portion of the intermediate shielding member and a rear end portion of the terminal shielding member clamped between an underlay pipe and a clamp ring.

2. The shielded wire harness as claimed in claim 1, wherein the terminal shielding member is configured by braided wires formed by metal thin lines braided in a meshed manner.

3. A shielding member for collectively enclosing a plurality of wires arranged to be juxtaposed to one another and each configured to be connected to a respective terminal disposed in a shield case of equipment, the shielding member comprising:

an intermediate shielding member configured to enclose the plurality of wires collectively except for a terminal portion of the plurality of wires;

a terminal shielding member connected to the intermediate shielding member and having larger diameter than that of the intermediate shielding member, and configured to enclose the plurality of wires collectively at the terminal portion where the plurality of wires are spread apart, the terminal shielding member and the intermediate shielding member being conductively connected to each other by having a front end portion of the intermediate shielding member and a rear end portion of the terminal shielding member clamped between an underlay pipe and a clamp ring, wherein an end portion of the terminal shielding member is configured to be connected to the shield case.

4. The shielding member as claimed in claim 3, wherein the terminal shielding member is configured by braided wires formed by metal thin lines braided in a meshed manner.

* * * * *